US011474481B2

(12) United States Patent
Hashizume et al.

(10) Patent No.: US 11,474,481 B2
(45) Date of Patent: Oct. 18, 2022

(54) MOVEMENT AND ELECTRONIC TIMEPIECE

(71) Applicant: Seiko Epson Corporation, Tokyo (JP)

(72) Inventors: Saori Hashizume, Shimosuwa (JP); Takaya Masaki, Matsumoto (JP)

(73) Assignee: SEIKO EPSON CORPORATION

( * ) Notice: Subject to any disclaimer, the term of this patent is extended or adjusted under 35 U.S.C. 154(b) by 592 days.

(21) Appl. No.: 16/580,235

(22) Filed: Sep. 24, 2019

(65) Prior Publication Data

US 2020/0096944 A1 Mar. 26, 2020

(30) Foreign Application Priority Data

Sep. 25, 2018 (JP) ..... JP2018-179031

(51) Int. Cl.

| | |
|---|---|
| ***G04C 3/14*** | (2006.01) |
| ***G04B 19/21*** | (2006.01) |
| ***G04B 29/04*** | (2006.01) |
| ***G04B 19/24*** | (2006.01) |

(52) U.S. Cl.

CPC ..... *G04B 19/21* (2013.01); *G04B 19/24* (2013.01); *G04B 29/04* (2013.01); *G04C 3/146* (2013.01)

(58) Field of Classification Search

CPC . G04C 9/00; G04C 3/14; G04C 3/146; G04B 19/21; G04B 29/04; G04B 19/24

See application file for complete search history.

(56) References Cited

U.S. PATENT DOCUMENTS

| | | | | |
|---|---|---|---|---|
| 6,454,458 | B1 * | 9/2002 | Born | G04C 3/14 368/76 |
| 10,429,797 | B2 * | 10/2019 | Miwa | G04C 17/0091 |
| 2019/0094806 | A1 * | 3/2019 | Kunimi | G04B 19/02 |

FOREIGN PATENT DOCUMENTS

| | | | |
|---|---|---|---|
| JP | S 61144493 | U * | 9/1986 |
| JP | 2006-119007 | A | 5/2006 |
| JP | 2010-223689 | A | 10/2010 |
| JP | 2016-008949 | A | 1/2016 |

* cited by examiner

*Primary Examiner* — Sean Kayes

(74) *Attorney, Agent, or Firm* — Harness, Dickey & Pierce, P.L.C.

(57) ABSTRACT

Provided is a movement enabling easily providing an indicator position detection mechanism in a movement enabling changing the locations of an indicator by changing the configuration of a wheel train. The movement includes an indicator wheel to which an indicator is attached; a motor that drives the indicator wheel; a detection wheel train used to detect a position of the indicator; and a main plate to which the indicator wheel, the motor, and the detection wheel train are disposed. The main plate is configured to enable selectively disposing the indicator wheel to a first position or a second position that is different from the first position. The detection wheel train is disposed to the same position whether the indicator wheel is disposed to the first position or the second position.

6 Claims, 12 Drawing Sheets

MOVEMENT AND ELECTRONIC TIMEPIECE

This application is based upon Japanese Patent Application 2018-179031 filed on Sep. 25, 2018, the entire contents of which are incorporated by reference herein.

BACKGROUND

1. Technical Field

The present invention relates to a movement having a hand position detection mechanism, and an electronic timepiece.

2. Related Art

As described in JP-A-2010-223689, timepieces that, by rearranging the wheel trains, can be configured with three subdials located at 3:00, 6:00, and 9:00, or with three subdials located at 12:00, 6:00, and 9:00, or with three subdials located at 2:00, 6:00, and 10:00, are known from the literature.

As described in JP-A-2016-8949, timepieces with a hand (indicator) position detection mechanism that detects the positions of the hands are also known.

JP-A-2010-223689, however, does not consider disposing a hand position detection mechanism as described in JP-A-2016-8949 in the timepiece described in JP-A-2010-223689.

SUMMARY

A movement according to a preferred aspect of the invention has an indicator wheel to which an indicator is attached; a motor that drives the indicator wheel; a detection wheel train used for detecting a position of the indicator; and a main plate to which the indicator wheel, the motor, and the detection wheel train are disposed. The main plate is configured to enable selectively disposing the indicator wheel to a first position or a second position that is different from the first position. The detection wheel train is disposed to the same position on the main plate whether the indicator wheel is disposed to the first position or the second position.

In a movement according to another aspect of the invention the main plate has a hole formed at the first position and the second position to support the pivot of the indicator wheel.

In a movement according to another aspect of the invention the main plate is configured to enable selectively disposing a first drive wheel train that drives the indicator wheel disposed to the first position, and a second drive wheel train that drives the indicator wheel disposed to the second position; and the detection wheel train is driven linked to the first drive wheel train or the second drive wheel train.

In a movement according to another aspect of the invention the detection wheel train has a wheel; and the second drive wheel train is configured by multiple wheels including the wheel of the detection wheel train.

In a movement according to another aspect of the invention the motor has a rotor pinion; the main plate is configured to enable disposing a drive wheel train that drives the indicator wheel and includes a first intermediate wheel that meshes with the rotor pinion, and a second intermediate wheel that meshes with the first intermediate wheel; and the detection wheel train is configured to include a first detection wheel that meshes with the first intermediate wheel and is different from the second intermediate wheel.

Another aspect of the invention is an electronic timepiece including an indicator, an indicator wheel to which the indicator is attached; a motor that drives the indicator wheel; a detection wheel train used to detect a position of the indicator; and a main plate to which the indicator wheel, the motor, and the detection wheel train are disposed. The main plate is configured to enable selectively disposing the indicator wheel to a first position or a second position that is different from the first position. The detection wheel train is disposed to the same position on the main plate whether the indicator wheel is disposed to the first position or the second position.

Other objects and attainments together with a fuller understanding of the invention will become apparent and appreciated by referring to the following description and claims taken in conjunction with the accompanying drawings.

DESCRIPTION OF EMBODIMENTS

Electronic Timepiece

Figure 1:
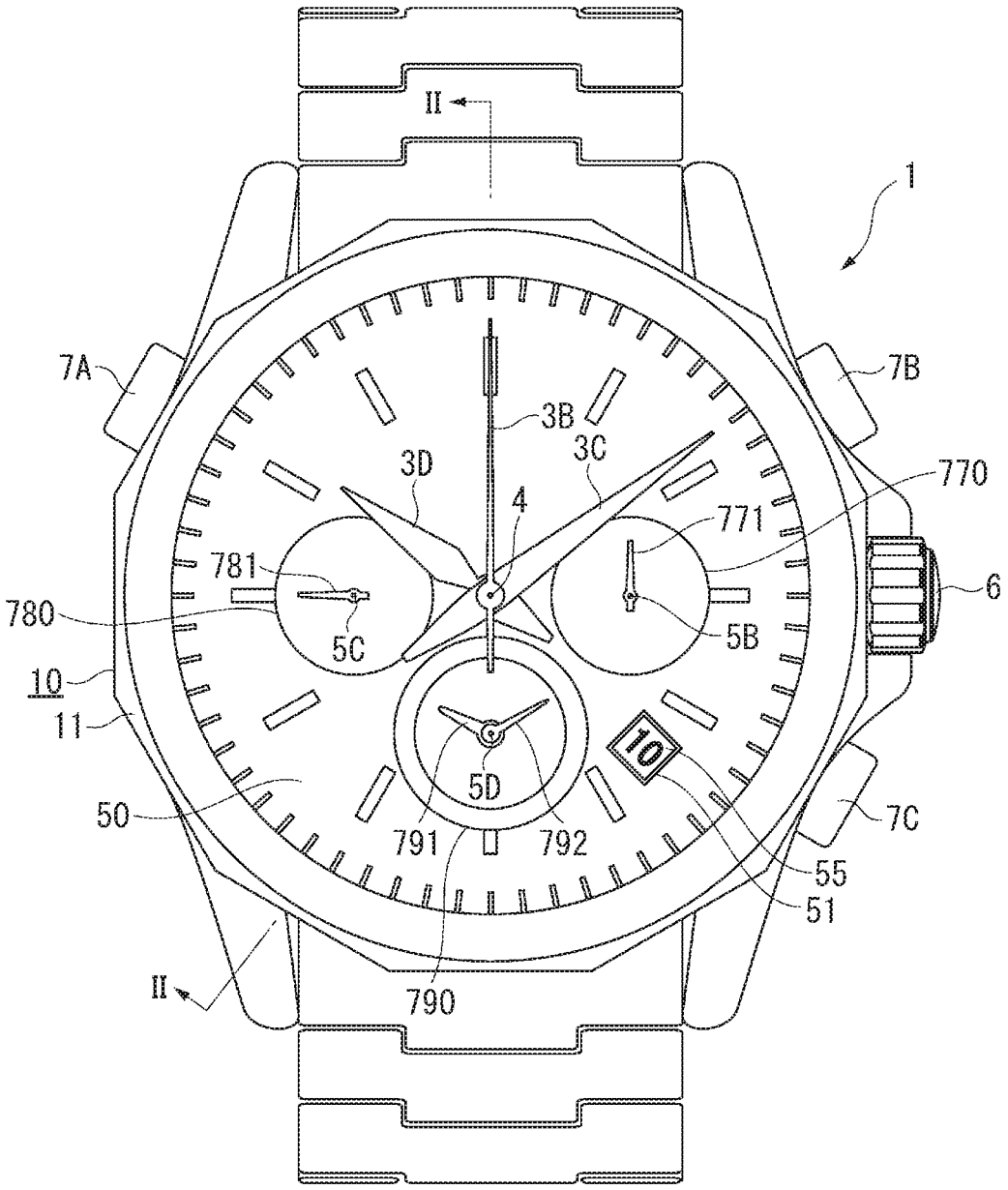
FIG. 1 shows the face of a first electronic timepiece according to a first embodiment of the invention.

As shown in FIG. 1, an electronic timepiece 1 according to this embodiment of the invention is a multifunction timepiece with three small windows 770, 780, 790. The configuration of this electronic timepiece 1 is described below with reference to FIG. 1 to FIG. 3.

Note that herein the views of the electronic timepiece 1 perpendicularly to the dial 50 from the crystal side and the back cover side are referred to as plan views.

The electronic timepiece 1 according to this embodiment is configured to receive satellite signals from positioning information satellites such as GPS satellites and quasi-zenith satellites that orbit the Earth on specific known orbits, acquire satellite time information, and adjust internal time information. The satellite signal reception process of the electronic timepiece 1 includes a manual reception mode that is started by the user operating a button, for example, and an automatic reception mode that starts automatically when specific conditions are met.

Figure 2:
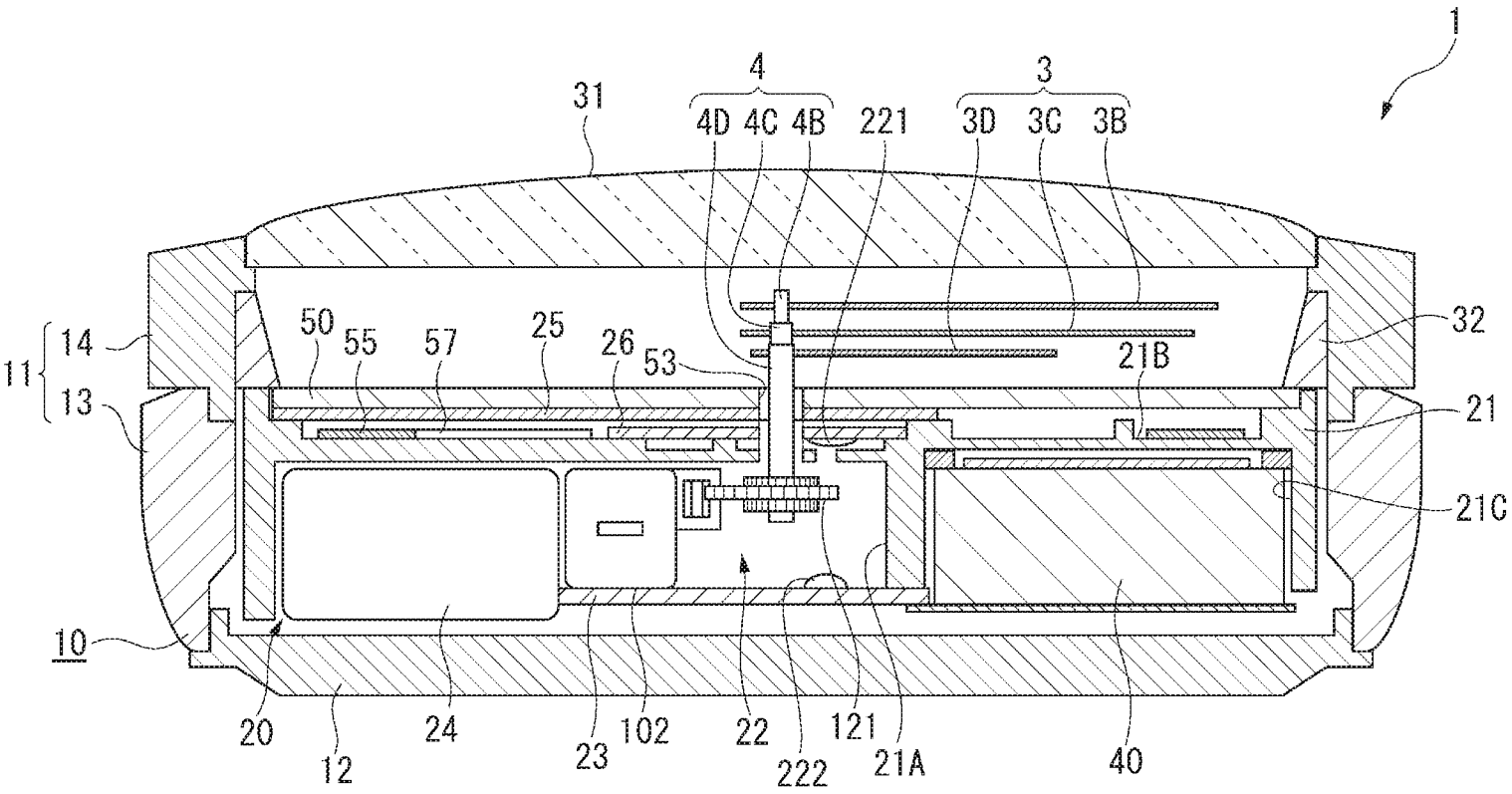
FIG. 2 is a section view through line II-II in FIG. 1.
Figure 3:
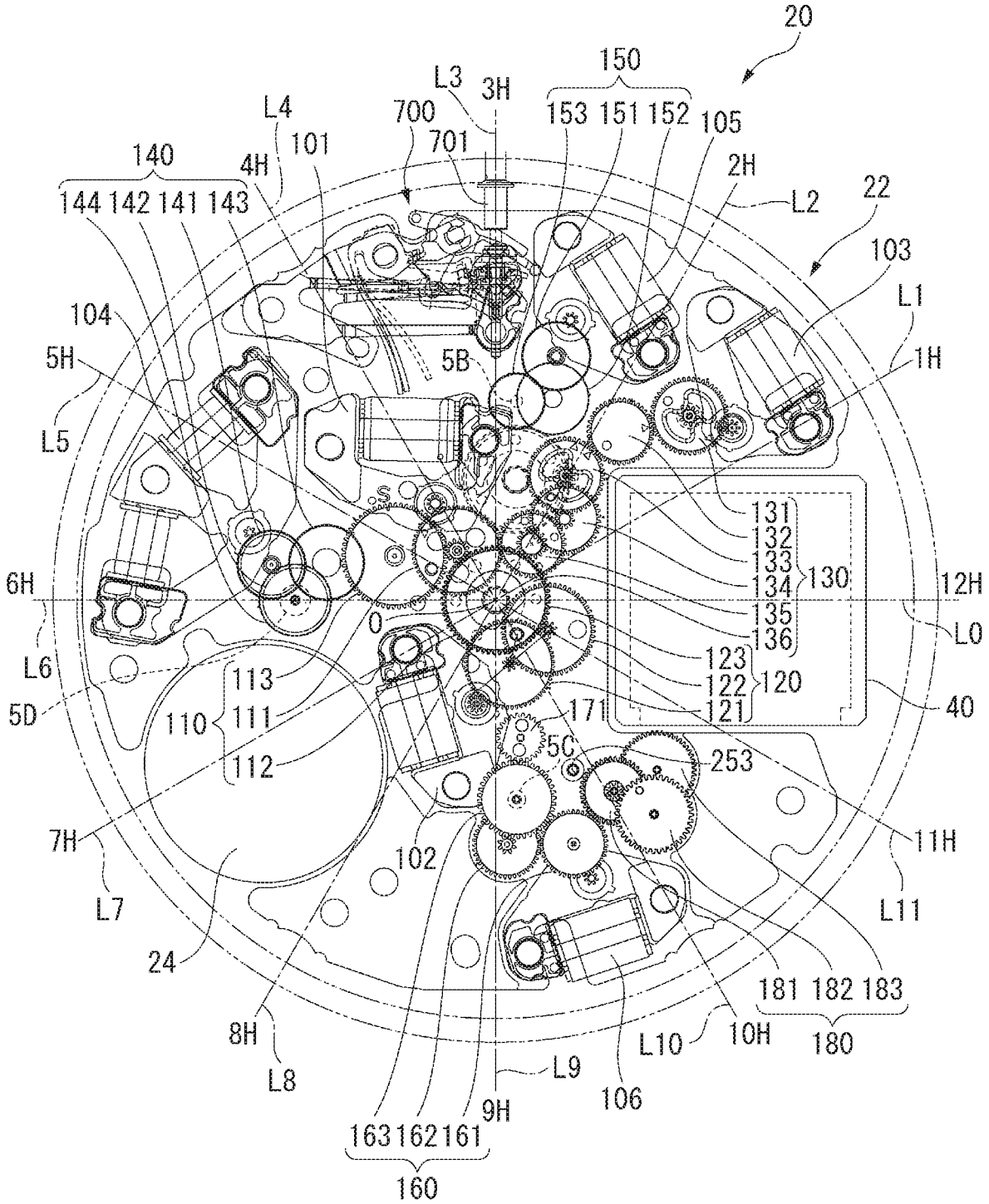
FIG. 3 is a plan view of the face side of the movement of the first electronic timepiece.

As shown in FIG. 1 to FIG. 3, the electronic timepiece 1 has an external case 10 that houses a dial 50, movement 20, planar antenna 40, and storage battery 24. The electronic timepiece 1 also has external operators such as a crown 6 and three buttons 7A, 7B, 7C, and a band connected to the external case 10.

The dial 50 is a round disk made of polycarbonate or other electrically non-conductive material. In the plane center O of the dial 50 is disposed a center arbor 4 passing through the dial 50, and hands 3 are attached to the center arbor 4. As shown in FIG. 2, the center arbor 4 includes a second hand pivot 4B, a minute hand pivot 4C, and an hour hand pivot 4D. A second hand 3B is attached to the second hand pivot 4B, a minute hand 3C is attached to the minute hand pivot 4C, and an hour hand 3D is attached to the hour hand pivot 4D.

The dial 50 has three windows. As shown in FIG. 1, relative to the plane center O of the dial 50 where the center arbor 4 is disposed, a round first subdial 770 and a small hand 771 are disposed at 3:00, a round second subdial 780 and small hand 781 are disposed at 9:00, and a round third subdial 790 and small hands 791 and 792 are disposed at 6:00.

A rectangular date window 51 is disposed relative to the plane center O of the dial 50 in the direction between 4:00 and 5:00, that is, at the 4:30 position. As shown in FIG. 2, a date indicator 55 is disposed on the back cover side of the dial 50, and the date indicator 55 can be seen through the date window 51. The dial 50 also has a through-hole 53 through which the through-hole 53 passes, and through-holes not shown through which the pivots 5B, 5C, 5D of the hands 771, 781, 791, 792 pass.

In this embodiment, the small hand 771 of the first subdial 770 is a day hand indicating the day of the week, and the small hand 781 of the second subdial 780 is a mode indicator (function indicator) for indicating other information other than time. The hands 791, 792 of the third subdial 790 are the hour hand and minute hand for indicating the time, such as the home time or local time, in a second time zone.

The secondhand 3B, minute hand 3C, hour hand 3D, hands 771, 781, 791, 792, and date indicator 55 are driven by a motor and wheel train described below.

The second subdial 780 has markers (not shown in the figure) pointed to by a mode indicator, the small hand 781 in this example, including a power indicator for indicating the power reserve of the storage battery 24, a daylight saving time mode setting, an airplane mode in which wireless communication is turned off, and a GPS satellite signal reception mode setting.

External Structure of the Electronic Timepiece

As shown in FIG. 1 to FIG. 3, the electronic timepiece 1 has an external case 10 housing the movement 20 and other components described below. Note that FIG. 2 is a section view through line II-II in FIG. 1 through the 7:00 position of the dial 50, the plane center O of the dial 50, and 12:00. FIG. 3 is a plan view of the main parts of the movement 20 from the back cover side.

As shown in FIG. 2, the external case 10 has a case member 11, back cover 12, and crystal 31. The case member 11 includes a cylindrical body 13, and a bezel 14 disposed on the face side of the body 13.

A round back cover 12 that closes the opening on the back cover side of the case member 11 is disposed on the back cover side of the case member 11. The back cover 12 connects to the body 13 of the case member 11 by a screw thread configuration. Note that in this embodiment the body 13 and back cover 12 are separate parts, but the invention is not so limited and the body 13 and back cover 12 may be integrated as a one-piece case.

The body 13, bezel 14, and back cover 12 in this embodiment are made from a metal such as stainless steel, a titanium alloy, aluminum, or brass.

Internal Configuration of the Electronic Timepiece

The internal configuration housed inside the external case 10 of the electronic timepiece 1 is described next.

In addition to the dial 50, a movement 20, planar antenna 40 (patch antenna), date indicator 55, and dial ring 32 are housed inside the external case 10 as shown in FIG. 2.

Note that, in the description of the movement 20 below, the back cover side of the main plate 21 is referred to as the front or face side, and the dial side of the main plate 21 is referred to as the back side.

The movement 20 includes a main plate 21, wheel train bridge (not shown in the figure), drive module 22 supported by the main plate 21 and wheel train bridge, circuit board 23, storage battery 24, solar cell panel 25, and light sensor circuit board 26.

The main plate 21 is made of plastic or other electrically non-conductive material. The main plate 21 has a drive module holder 21A for holding the drive module 22; a date indicator holder 21B where the date indicator 55 is disposed; and an antenna holder 21C where the planar antenna 40 is housed. The date indicator holder 21B is configured as a ring-shaped channel formed on the back side of the main plate 21.

The drive module holder 21A and antenna holder 21C are disposed on the front side of the main plate 21. Because the antenna holder 21C is at the 12:00 position of the dial 50 in plan view, the planar antenna 40 is at the 12:00 position as shown in FIG. 3. More specifically, the planar antenna 40 is located between the center arbor 4 of the hands 3 and the case member 11, and between the approximately 11:00 and approximately 1:00 positions on the dial 50. Therefore, as shown in FIG. 3, on a 12:00 imaginary line L0 from the plane center O of the dial 50 toward 12:00, at least part of the planar antenna 40 is superimposed on the 12:00 imaginary line L0 in plan view. More specifically, the plane center of the planar antenna 40 is superimposed in plan view with the 12:00 imaginary line L0. Note that the plan view in reference to FIG. 3 means looking at the front side, that is, from the back cover 12 side, of the movement 20.

Note that the line connecting the center arbor 4 at the plane center O of the dial 50 and the 12:00 position on the dial 50 is referred to below as the 12:00 imaginary line L0 described above; the lines connecting the center arbor 4 to the 1:00 to 11:00 positions are referred to as the 1:00 imaginary line L1, 2:00 imaginary line L2, 3:00 imaginary line L3, 4:00 imaginary line L4, 5:00 imaginary line L5, 6:00 imaginary line L6, 7:00 imaginary line L7, 8:00 imaginary line L8, 9:00 imaginary line L9, 10:00 imaginary line L10, and 11:00 imaginary line L11.

The storage battery 24 is disposed in an area including 6:00 on the dial 50 when the area superimposed on the dial 50 in plan view is divided into two areas by the 3:00 imaginary line L3 and the 9:00 imaginary line L9. More specifically, in plan view, the storage battery 24 is disposed to a position between the 6:00 imaginary line L6 and the 8:00 imaginary line L8, that is, superimposed on the 7:00 imaginary line L7.

The drive module 22 is housed in the drive module holder 21A of the main plate 21, and drives the second hand 3B, minute hand 3C, hour hand 3D, hands 771, 781, 791, 792 date indicator 55.

As shown in FIG. 3, the drive module 22 includes a first motor 101 and first wheel train 110 for driving the second hand 3B; a second motor 102 and second wheel train 120 for driving the minute hand 3C; and a third motor 103 and third wheel train 130 for driving the hour hand 3D.

The drive module 22 also has a fourth motor 104 and fourth wheel train 140 for driving small hands 791, 792; a fifth motor 105 and fifth wheel train 150 for driving small hand 771; and a sixth motor 106 and sixth wheel train 160 for driving small hand 781. The sixth motor 106 and sixth wheel train 160 thus configure a drive mechanism for driving the small hand 781, which in this example is a function indicator.

The date indicator 55 may be driven by adding another dedicated motor, but in this embodiment of the invention is configured to move the date indicator 55 one day when the small hand 781 turns a specific number of revolutions, such as six revolutions, by adding a date indicator wheel train 170 including a Geneva drive to the sixth motor 106 and sixth wheel train 160 that drive the small hand 781. A indicator position detection wheel train 180 that moves in conjunction with the sixth wheel train 160 is also provided for detecting the position of the small hand 781.

The motors 101 to 106 are stepper motors for keeping time, and only the fourth motor 104 is a two-coil stepper motor having two coils.

As shown in FIG. 2, the motors 101 to 106 and an IC chip embodying a controller 60 are mounted on the circuit board 23, which is disposed to the back cover side of the main plate 21 and affixed to the main plate 21 by screws in this example.

A solar cell panel 25 is disposed to the back side of the dial 50, and converts light received through the dial 50 to electrical energy. Note that to assure sufficient output voltage without using a boost converter, the solar cell panel 25 is divided into multiple cells, such as six to eight, and the cells are connected in series. The power generated by the solar cell panel 25 charges the storage battery 24 through the circuit board 23.

The light sensor circuit board 26 is disposed, as shown in FIG. 2, between the solar cell panel 25 and the main plate 21. The light-emitting devices 211, 221, 231, 241 of the indicator position detectors 210, 220, 230, 240 are disposed to the light sensor circuit board 26.

Motor Locations

In plan view, the first motor 101 is disposed to a position superimposed on the 4:00 imaginary line L4, and between the winding stem 701 of the setting mechanism 700 and the center arbor 4 (plane center O), as shown in FIG. 3.

In plan view, the second motor 102 is disposed to a position superimposed on the 8:00 imaginary line L8, and between the storage battery 24 and planar antenna 40.

In plan view, the third motor 103 is disposed to a position between the winding stem 701 of the setting mechanism 700 and the planar antenna 40, and more specifically between the 2:00 imaginary line L2 and planar antenna 40. Part of the third motor 103 is superimposed on the 1:00 imaginary line L1.

In plan view, the fourth motor 104 is disposed to a position between the storage battery 24 and winding stem 701 of the setting mechanism 700, and superimposed on the 5:00 imaginary line L5 and the 6:00 imaginary line L6.

In plan view, the fifth motor 105 is disposed to a position superimposed on the 2:00 imaginary line L2, and between the winding stem 701 of the setting mechanism 700 and the third motor 103.

In plan view, the sixth motor 106 is disposed to a position with part superimposed on the 10:00 imaginary line L10, and the rotor and coil of the sixth motor 106 between the 9:00 imaginary line L9 and the 10:00 imaginary line L10.

As a result, the motors 101 to 106 are disposed to positions in plan view not superimposed with the planar antenna 40, storage battery 24, or winding stem 701.

Figure 4:
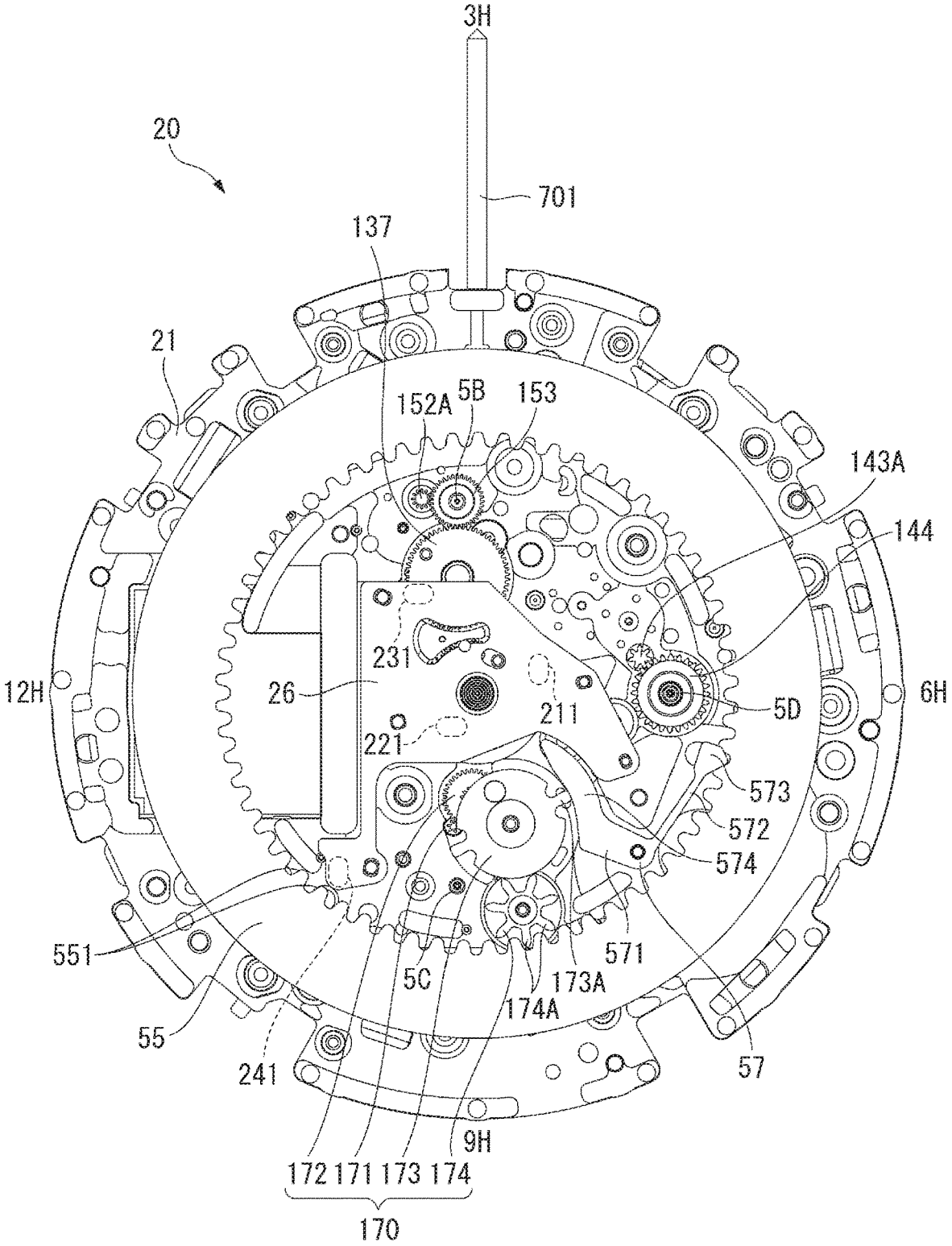
FIG. 4 is a plan view of the back side of the movement of the first electronic timepiece.

As shown in FIG. 4, the pivot 5B to which the small hand 771 is attached, the pivot 5C to which the small hand 781 is attached, and the pivot 5D to which the hands 791, 792 are attached are all disposed within the inside circumference of the date indicator 55.

As shown in FIG. 3, the first wheel train 110 includes an intermediate second wheel 111 that meshes with the rotor pinion of the first motor 101, a second wheel 112 that meshes with the pinion of the intermediate second wheel 111, and a second detector wheel 113 that meshes with the pinion of the intermediate second wheel 111. The second hand 3B attaches to the second hand pivot 4B of the second wheel 112.

An indicator position detection hole that is detected by the indicator position detector 210 described below is formed in the intermediate second wheel 111 and the second detector wheel 113. Note that wheels with an indicator position detection hole are also disposed to the second wheel train 120, third wheel train 130, and indicator position detection wheel train 180, and indicator position detectors 220, 230, 240 corresponding to these holes are also provided.

The indicator position detector 210 includes a fifth wheel 121 that meshes with the rotor pinion of the second motor 102, a third wheel 122 that meshes with the pinion of the fifth wheel 121, and a second wheel 123 that meshes with the pinion of the third wheel 122. The second wheel 123 is superimposed in plan view with the second wheel 112. The minute hand 3C attaches to the minute hand pivot 4C of the second wheel 123.

The third wheel train 130 includes a first hour intermediate wheel 131 that meshes with the rotor pinion of the third motor 103; a second hour intermediate wheel 132 that meshes with the first hour intermediate wheel 131; a third hour intermediate wheel 133 that meshes with the second hour intermediate wheel 132; a fourth hour intermediate wheel 134 that meshes with the pinion of the third hour intermediate wheel 133; a fifth hour intermediate wheel 135 that meshes with the pinion of the fourth hour intermediate wheel 134; and an hour wheel and pinion 136 that meshes with the pinion of the fifth hour intermediate wheel 135. The hour wheel and pinion 136 is superimposed in plan view with the second wheel 112 and second wheel 123. The hour hand 3D attaches to the hour hand pivot 4D of the hour wheel and pinion 136.

As shown in FIG. 4, a hour detection wheel 137 disposed on the back side of the main plate 21 meshes with the pinion of the fifth hour intermediate wheel 135.

The fourth wheel train 140 is the wheel train for driving the hands 791, 792 for indicating the home time (HT), and as shown in FIG. 3 includes a home-time intermediate wheel 141 that meshes with the rotor pinion of the fourth motor 104; a home-time minute wheel 142 that meshes with the pinion of the home-time intermediate wheel 141; a home-time minute wheel and pinion 143 that meshes with the pinion of the home-time minute wheel 142; and a home-time hour wheel and pinion 144 that meshes with the pinion 143A of the home-time minute wheel and pinion 143 as shown in FIG. 4. In plan view, the home-time hour wheel and pinion 144 is superimposed with the home-time minute wheel 142, and is disposed on the back side of the main plate 21.

The small hand 791, which is the minute hand for home time, attaches to the home-time minute wheel 142, and the small hand 792, which is the hour hand for home time, attaches to the home-time hour wheel and pinion 144.

More specifically, the fourth motor 104 drives the hands 791, 792 that attach to the pivot 5D located toward 6:00 relative to the center arbor 4.

The fifth wheel train 150 is the wheel train that drives the small hand 771, which is disposed at the 3:00 position and is the day hand indicating the day of the week. As shown in FIG. 3 and FIG. 4, the fifth wheel train 150 includes a small day first intermediate wheel 151 that meshes with the rotor pinion of the fifth motor 105; a small day second intermediate wheel 152 that meshes with the pinion of the small day first intermediate wheel 151; and a small day wheel 153 that meshes with the pinion 152A of the small day second intermediate wheel 152. The small day wheel 153 is disposed on the back side of the main plate 21, and the small hand 771 attaches to pivot 5B of the small day wheel 153.

Note that because the hour detection wheel 137 and the small day wheel 153 are at different heights, they do not mesh with each other.

In this electronic timepiece 1, the small day wheel 153 is superimposed in plan view with the 3:00 imaginary line L3. More specifically, the small day wheel 153 is disposed to a position where the angle of intersection between the 3:00 imaginary line L3 and a line through the pivot position of the pivot 5B of the small day second intermediate wheel 152 and the center arbor 4 is approximately 4 to 8 degrees, for example, 6 degrees.

Figure 6:
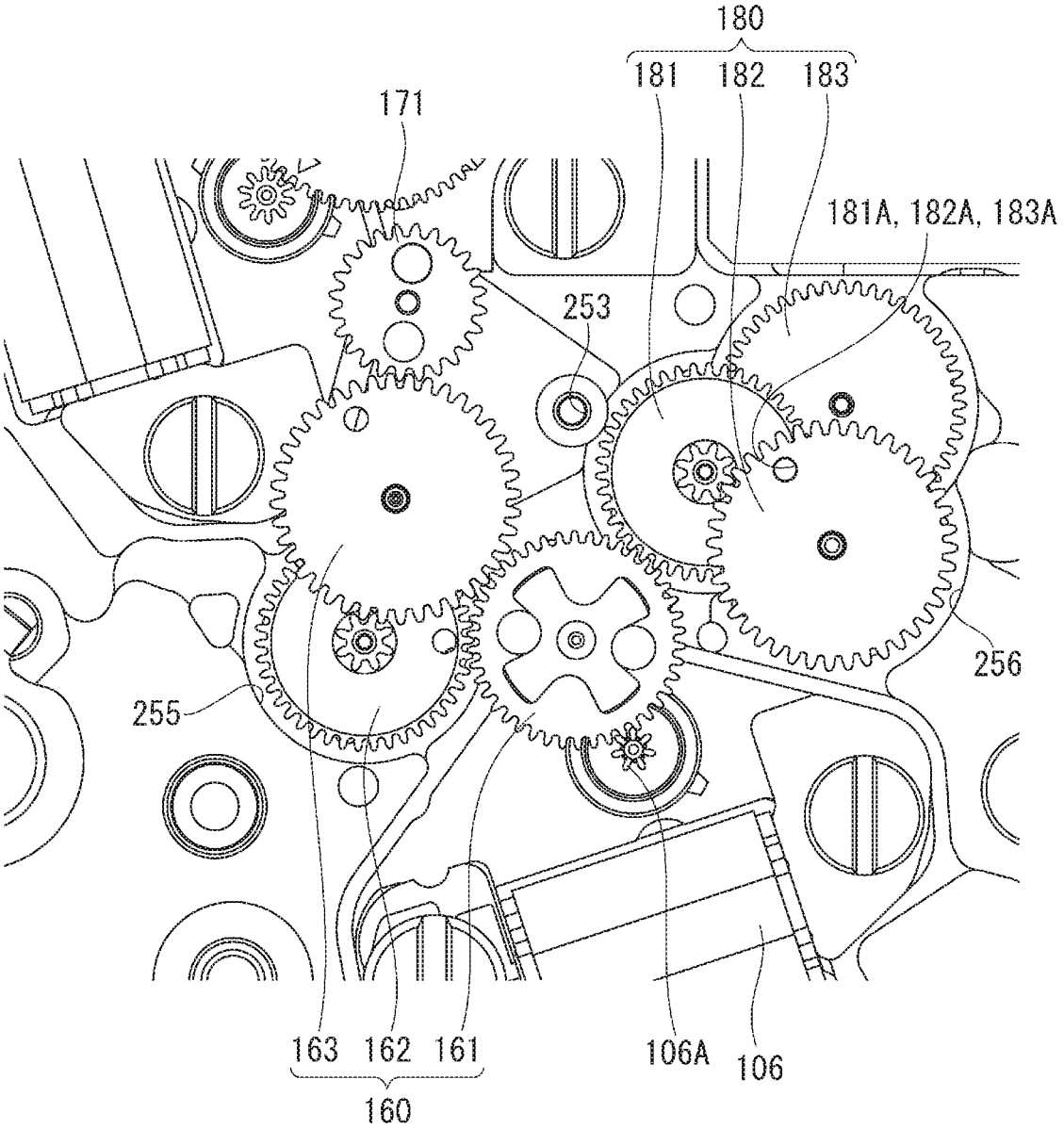
FIG. 6 is a plan view of the wheel train for driving the mode indicator, and the wheel train of the indicator position detection mechanism, in the first electronic timepiece.

The sixth wheel train 160 is a wheel train for driving the small hand 781, which is a mode indicator (function indicator) and is disposed at a 9:00 position. As shown in FIG. 3 and FIG. 6, the sixth wheel train 160 includes a mode indicator first intermediate wheel 161 that meshes with the rotor pinion 106A of the sixth motor 106; a mode indicator second intermediate wheel 162 that meshes with the mode indicator first intermediate wheel 161; and a mode indicator wheel 163 that meshes with the pinion of the mode indicator second intermediate wheel 162. The small hand 781 attaches to the pivot 5C of the mode indicator wheel 163.

As shown in FIG. 3, in this electronic timepiece 1, the mode indicator second intermediate wheel 162 and mode indicator wheel 163 are disposed to positions superimposed in plan view with the 9:00 imaginary line L9. More specifically, the mode indicator second intermediate wheel 162 and mode indicator wheel 163 are disposed to positions where the angle of intersection between the 9:00 imaginary line L9 and a line through the pivot position of the pivot 5C of the mode indicator wheel 163 and the center arbor 4 is approximately 4 to 8 degrees, for example, 6 degrees.

Date Indicator Wheel Train

The date indicator wheel train 170, which drives the date indicator 55 in conjunction with the small hand 781, and more specifically in conjunction with the sixth wheel train 160 that drives the small hand 781, is described next with reference to FIG. 3 to FIG. 6.

Figure 5:
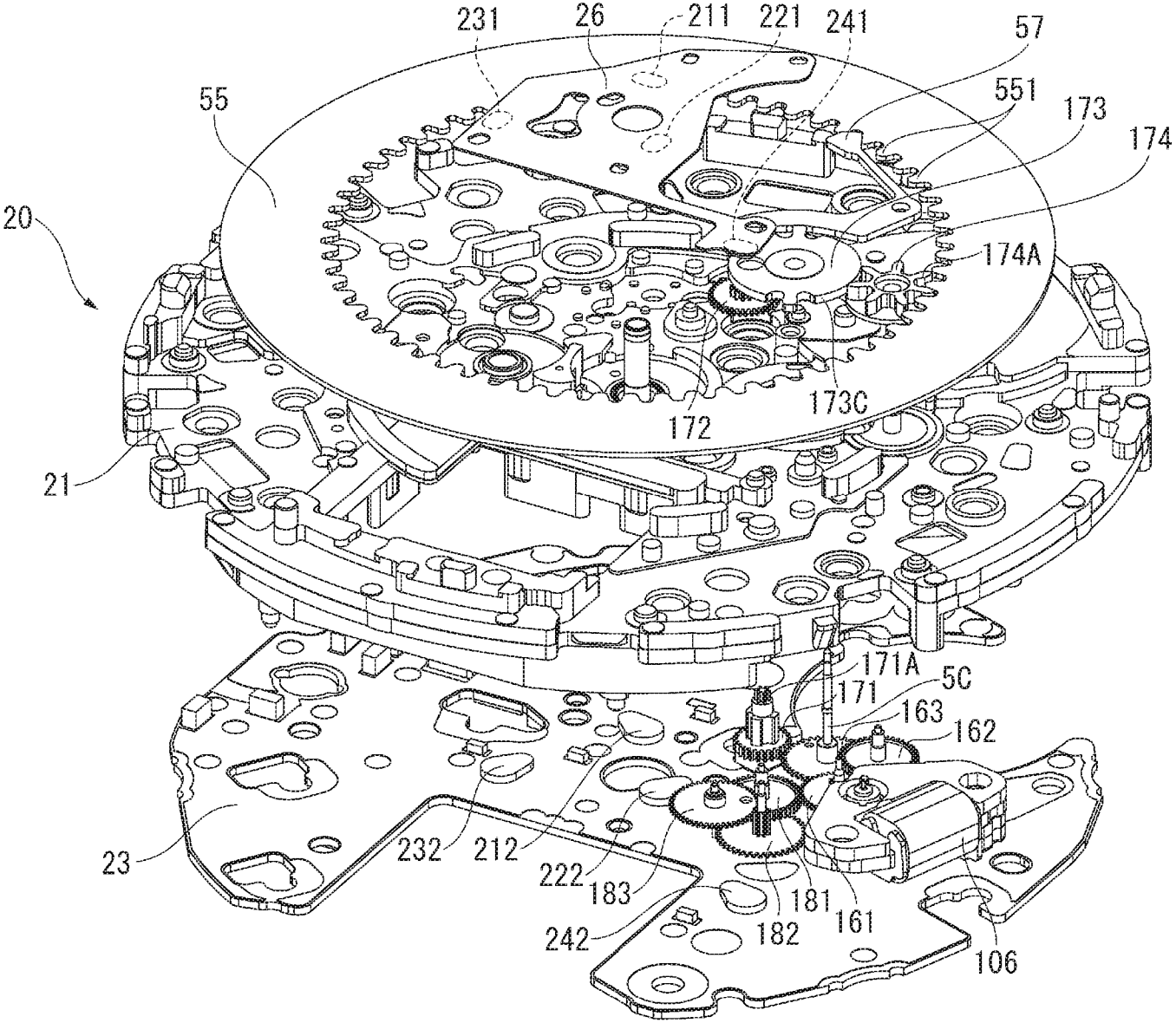
FIG. 5 is an exploded oblique view of main parts of the movement of the first electronic timepiece.

FIG. 3 is a plan view of main parts of the movement 20 described above from the back cover side. FIG. 4 is a plan view of the movement 20 from the dial side. FIG. 5 is an exploded oblique view of main parts of the movement 20. FIG. 6 is a plan view of the sixth wheel train 160 that drives a hand (mode indicator) 781 of the electronic timepiece 1, and the indicator position detection wheel train 180.

As shown in FIG. 3 to FIG. 6, the date indicator wheel train 170 includes a first intermediate date wheel 171, second intermediate date wheel 172, third intermediate date wheel 173, and date indicator driving wheel 174. The first intermediate date wheel 171 meshes with the mode indicator wheel 163, and its pivot passes through the main plate 21. The pinion 171A disposed to the pivot of the first intermediate date wheel 171 is exposed on the dial side of the main plate 21.

The second intermediate date wheel 172 and third intermediate date wheel 173 are disposed between the main plate 21 and the dial 50. The second intermediate date wheel 172 meshes with the pinion 171A of the first intermediate date wheel 171, and the third intermediate date wheel 173 meshes with the pinion of the second intermediate date wheel 172.

As shown in FIG. 4 and FIG. 5, the third intermediate date wheel 173 has a pair of drive teeth 173A formed on opposite sides of the pivot. A pair of recesses 173B is formed at the base of each drive tooth 173A. The portion of the outside circumference surface of the third intermediate date wheel 173 other than the drive teeth 173A and the recesses 173B forms a curved restriction surface 173C.

The date indicator driving wheel 174 has multiple teeth 174A formed equidistantly around the circumference. The date indicator driving wheel 174 in this embodiment has seven teeth 174A. These teeth 174A mesh with the drive teeth 173A. The teeth 174A also mesh with the internal teeth 551 of the date indicator 55. Therefore, each time the third intermediate date wheel 173 turns 180°, it turns the date indicator driving wheel 174 two teeth (360°×2/7), and turns the date indicator 55. When the drive teeth 173A are not meshed with the teeth 174A of the date indicator driving wheel 174, two teeth 174A of the date indicator driving wheel 174 are touching the restriction surface 173C of the third intermediate date wheel 173, and rotation of the date indicator driving wheel 174, and therefore the date indicator 55, is restricted. The third intermediate date wheel 173 and date indicator driving wheel 174 thus form a Geneva drive in the date indicator wheel train 170.

Indicator Position Detection Wheel Train

The indicator position detection wheel train 180, which turns in conjunction with the sixth wheel train 160, is described next.

As shown in FIG. 3, FIG. 5, and FIG. 6, the indicator position detection wheel train 180 has three wheels, a first detection wheel 181 that meshes with the mode indicator first intermediate wheel 161, a second detection wheel 182 that meshes with the pinion of the first detection wheel 181, and a third detection wheel 183 that meshes with the pinion of the second detection wheel 182.

When the mode indicator first intermediate wheel 161 is turned by the sixth motor 106, the first detection wheel 181, second detection wheel 182, and third detection wheel 183 turn sequentially in a speed reduction train. A through-hole 181A, 182A, 183A is respectively formed in each of the detection wheels 181, 182, 183, and the through-holes 181A, 182A, 183A are formed so that they are superimposed with each other in plan view at one location in one revolution of the third detection wheel 183.

Note that because the mode indicator second intermediate wheel 162 and the first detection wheel 181 both mesh with the mode indicator first intermediate wheel 161, they are configured by the same wheel, and as described in the electronic timepiece 1B below, are configured so that the mode indicator wheel 163B can also mesh with the first detection wheel 181.

Date Jumper

The date indicator 55 is regulated by a date jumper 57. As shown in FIG. 4, the date jumper 57 has a base portion 571 attached freely rotationally on a pivot disposed to the main plate 21; an arm 572 extending from the base portion 571; a pawl 573 that engages the internal teeth 551 and is disposed on the distal end of the arm 572; and a guide 574 extending from the base portion 571 along the outside surface of the third intermediate date wheel 173.

The arm 572 has spring, and is configured to flex when the pawl 573 engages the internal teeth 551, and push the pawl 573 against the base portion 571 by the spring force corresponding to the flexure.

The guide 574 has a curved face opposite the third intermediate date wheel 173. As shown in FIG. 4, this curved face is configured to guide the drive teeth 173A of the third intermediate date wheel 173.

In the indicator display range where the small hand 781 indicates the mode, the drive teeth 173A of the third intermediate date wheel 173 move in the range of continuous contact with the curved face of the guide 574. As a result, because the position of the guide 574 is restricted by the drive teeth 173A, the date jumper 57 is held with the pawl 573 engaged with the internal teeth 551.

However, when the drive teeth 173A are outside the range of contact with the curved face, the guide 574 is separated from the restriction surface 173C of the third intermediate date wheel 173. As a result, the date jumper 57 can rotate in the direction in which the guide 574 approaches the restriction surface 173C. As a result, the pawl 573 of the date jumper 57 releases the internal teeth 551. Therefore, when the date indicator driving wheel 174 turns the date indicator 55, restriction of the date indicator 55 by the date jumper 57 is released, and the torque required to turn the date indicator 55 can be reduced.

Indicator Position Detectors

As described above, the electronic timepiece 1 has four indicator position detectors 210, 220, 230, 240. As shown in FIG. 4 and FIG. 5, the indicator position detector 210 has a light-emitting device 211 disposed to the light sensor circuit board 26, and a photodetector 212 disposed to the circuit board 23. Similarly, the indicator position detector 220 has a light-emitting device 221 disposed to the light sensor circuit board 26, and a photodetector 222 disposed to the circuit board 23. The indicator position detector 230 has a light-emitting device 231 disposed to the light sensor circuit board 26, and a photodetector 232 disposed to the circuit board 23. The indicator position detector 240 has a light-emitting device 241 disposed to the light sensor circuit board 26, and a photodetector 242 disposed to the circuit board 23.

Setting Mechanism

The setting mechanism 700 is a device that operates in conjunction with operation of the crown 6, and is a typical setting mechanism having, in addition to the winding stem 701 to which the crown 6 is attached, a setting lever, yoke, click spring, switch lever, setting lever holder, switch contact spring body, switch contact spring, and switch wheel as shown in FIG. 3.

As shown in FIG. 3 and FIG. 4, the winding stem 701 is disposed in the movement 20 at the 3:00 position on the dial 50 as seen in plan view.

The setting mechanism 700 having a setting lever and other parts in addition the winding stem 701 is disposed across the 3:00 imaginary line L3 and 4:00 imaginary line L4 along the outside circumference of the dial 50.

While not shown in the figures, a circuit cover, magnetic shield, antenna holder, wheel train bridge, and other components are also disposed on the front side of the main plate 21 in addition to the configurations described above.

While also not shown in the figures, hour wheel bridge, magnetic shield, date indicator bridge, and other components are also disposed on the back side of the main plate 21 in addition to the configurations described above.

The configurations of these elements are known from the literature, and further description thereof is omitted.

Controller

Figure 7:
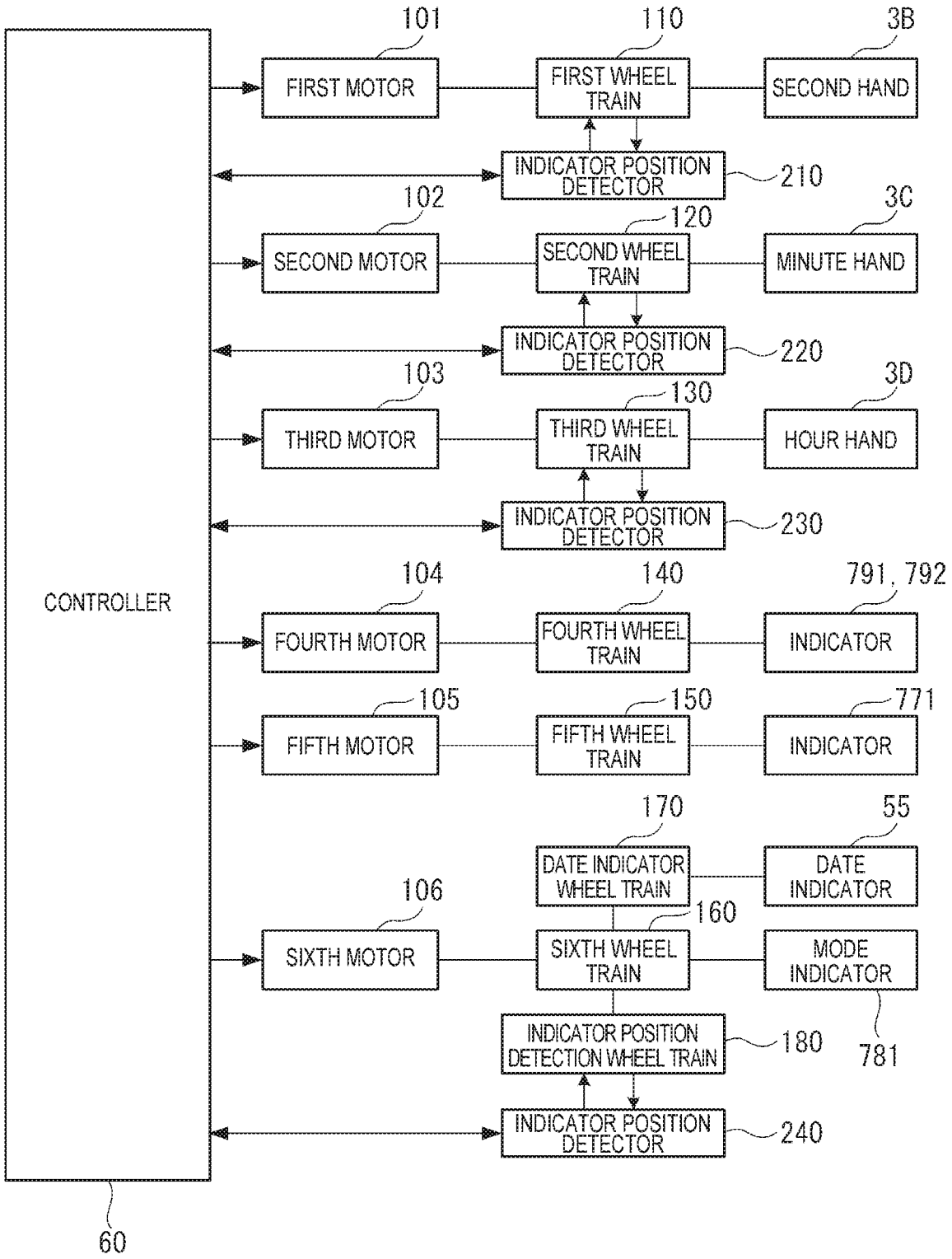
FIG. 7 is a block diagram showing the relationship between the controller, motor, wheel trains, and indicator position detectors of the electronic timepiece.

The controller 60 of the electronic timepiece 1 is described next. FIG. 7 is a block diagram showing the relationship between the controller 60 of the electronic timepiece and the motors, wheel trains, and indicator position detectors.

The controller 60 in this example is embodied by an IC chip on the circuit board 23, and controls operations of the electronic timepiece 1. As shown in FIG. 7, the controller 60 controls driving the first motor 101 to the sixth motor 106. The controller 60 also controls driving the indicator position detectors 210, 220, 230, 240 and executing the indicator position detection process.

Indicator Position Detector for the Function Indicator

The indicator position detector 240 that detects the indicator position of the small hand 781, which is the mode indicator, is described in detail below.

As shown in FIG. 6, the indicator position detector 240 detects the position of the indicator position detection wheel train 180, or more specifically the position of the small hand 781 driven by the sixth wheel train 160, by the photodetector 242 disposed to the circuit board 23 detecting the light emitted from the light-emitting device 241 disposed to the light sensor circuit board 26 passing through the through-holes 181A, 182A, 183A in the indicator position detection wheel train 180, which turns in conjunction with the sixth wheel train 160 that drives the small hand 781.

In this embodiment of the invention, the position of one drive tooth 173A of the third intermediate date wheel 173 disposed between the guide 574 and the date indicator driving wheel 174 is the indicator position detection position. More specifically, as described below, the indicator position detection position is set to +120 steps past the number of motor steps from a reference position at 0 steps.

In this embodiment of the invention the sixth motor 106 and sixth wheel train 160 are configured so that when the sixth motor 106 moves one step, the mode indicator wheel 163 and small hand 781 turn 6°. As a result, when the sixth motor 106 drives 60 steps, the mode indicator wheel 163 and small hand 781 turn 360° (one revolution).

The second detection wheel 182 of the indicator position detection wheel train 180 and the mode indicator wheel 163 are configured by the same wheel, and when the sixth motor 106 drives 60 steps, the second detection wheel 182 turns the same 360° (one revolution) as the mode indicator wheel 163. As a result, the first detection wheel 181 and the through-holes 181A and 182A in the second detection wheel 182 overlap (are coincident) once each time the sixth motor 106 drives 60 steps.

The through-hole 183A in the third detection wheel 183 is configured to overlap the through-holes 181A and 182A when the sixth motor 106 drives a multiple of 60 steps. In this embodiment of the invention the indicator position detection wheel train 180 is set so that the third detection wheel 183 turns one revolution (moves 360°) when the sixth motor 106 drives 360 steps. Therefore, the through-holes 181A, 182A, and 183A of the detection wheels 181, 182, 183 overlap at one step in each 360 steps, which is a multiple of 60 steps, the sixth motor 106 is driven. The small hand 781 is therefore always detected at the same position. Note that when the sixth motor 106 drives 360 steps, the small hand 781 turns six revolutions.

In addition, when the sixth motor 106 drives 360 steps, the third intermediate date wheel 173 turns 180°. At this time, the date indicator driving wheel 174 is driven two teeth (360°×2/7) by the drive teeth 173A of the third intermediate date wheel 173. The internal gear of the date indicator 55 has 62 teeth, and when the date indicator driving wheel 174 turns two teeth, the date indicator 55 moves two teeth, that is, one day.

The reference position of the small hand 781 in this embodiment is the position where the small hand 781 points to the F marker of the power indicator, that is, is positioned pointing to 9:00 in the second subdial 780 as shown in FIG. 1.

In this embodiment, expressed as the number of motor steps from the reference position at 0, the indicator display range in which the small hand 781 indicates mode information is the range from approximately −30 to +30 steps, that is, the range in which the small hand 781 turns approximately one revolution (360°) from −180° to +180°. In this event, the angle the third intermediate date wheel 173 turns is approximately 30°, and as shown in FIG. 4, the drive teeth 173A move in the range in contact with and guided by the curved face of the guide 574.

As a result, the date jumper 57 is held in the position with the guide 574 in contact with the drive teeth 173A, the pawl 573 is engaged with the internal teeth 551, and the date jumper 57 is enabled.

The range in which the date jumper 57 function is enabled (date jumper enabled range), expressed by the number of motor steps, is approximately −60 to +60 steps, and the angle the third intermediate date wheel 173 turns is approximately 60°. More specifically, the date jumper enabled range is set so that a drive tooth 173A contacts the guide 574 when the third intermediate date wheel 173 turns in a range of approximately 60°.

The date driving range in which the drive teeth 173A turns the date indicator driving wheel 174 and drives the date indicator 55, expressed by the number of motor steps, is a range of approximately +150 steps to +240 steps. Note that because the state of the small hand 781 and wheel train is the same at +180 steps and −180 steps, if expressed as a continuous range from +180 to −180, the date driving range is from +180 steps to −120 steps.

The indicator position detection position is outside the enabled range of the date jumper 57, and outside the date driving range, and, expressed by the number of motor steps, is set to the position at +120 steps in this example.

Indicator Position Detection Process of the Function Indicator

The regularly executed indicator position detection process of detecting the position of the small hand 781 as an example of a function indicator is described below.

The wheel train that drives the small hand 781 is also used as the date driver wheel train, and the sixth wheel train 160 that drives the small hand 781 when the date indicator 55 advances one day, and the indicator position detection wheel train 180 that operates in conjunction with the sixth wheel train 160, drive one revolution. As a result, while driving the sixth motor 106 quickly in one step increments to advance the date, the controller 60 executes the indicator position detection process that causes the light-emitting device 241 to emit and checks whether or not light was detected by the photodetector 242. As a result, the controller 60 can detect the reference position of the small hand 781.

Scheduled Indicator Position Detection of the Second Hand, Minute Hand, and Hour Hand The scheduled indicator position detection process detecting the locations of the second hand 3B, minute hand 3C, and hour hand 3D is timed to when the hands are normally at the 12:00 position, which is the indicator position detection position, at 00:00:00 and 12:00:00. Note that the indicator position detection process of the second hand 3B, minute hand 3C, and hour hand 3D is not limited to twice daily, and may execute only once a day (at 00:00:00 or 12:00:00).

The second hand 3B, minute hand 3C, hour hand 3D position detection process may execute as known from the literature. For example, the controller 60 may first control the indicator position detector 210 to detect the indicator position of the secondhand 3B, then control indicator position detector 220 to detect the indicator position of the minute hand 3C, and finally control indicator position detector 230 to detect the indicator position of the hour hand 3D.

When the controller 60 detects the position of the small hand 781, that is, the mode indicator, in addition to the second hand 3B, minute hand 3C, and hour hand 3D, the controller 60 preferably detects the positions of the second hand 3B, minute hand 3C, and hour hand 3D, and then detects the position of the small hand 781. By sequentially detecting the position of each hand, a temporary increase in consumption current can be suppressed.

Indicator Position Detection During a System Reset

When the system is reset, the value of the indicator position counter storing the position of each hand is also reset. As a result, the controller 60 sequentially executes the indicator position detection processes for the second hand 3B, minute hand 3C, hour hand 3D, and small hand 781.

The indicator position detection processes of the controller 60 detecting the positions of the second hand 3B, minute hand 3C, and hour hand 3D is the same as conventional processes. More specifically, the controller 60 executes the indicator position detection process of controlling the indicator position detectors 210 to 230 while driving the motors 101 to 103 that move the hands one step at a time.

As in the scheduled indicator position detection process, the controller 60 executes the indicator position detection process while driving the small hand 781 one revolution in one direction.

Based on the time information acquired by the satellite signal reception process, the controller 60 then drives the motors 101 to 106 to display the current time by the hands and the date indicator 55. When the buttons 7A to 7C or crown 6 are manually operated, the controller 60 also drives the hands and date indicator 55 to display the time set by the manual adjustment.

Indicator Position Detection when Setting the Reference Position

The electronic timepiece 1 also has a function for executing the indicator position detection process when, for example, the user notices a shift in the position indicated by the small hand 781 and operates the crown 6 or button 7A to assert a command for resetting the small hand 781 to the reference position. The indicator position detection process in this case is the same as the process executed in a system reset, and further description thereof is omitted.

Second Electronic Timepiece

An electronic timepiece 1B that changes the locations of the first subdial 770 and second subdial 780 from the locations thereof in the electronic timepiece 1 described above is described next with reference to FIG. 8 to FIG. 10.

Figure 8:
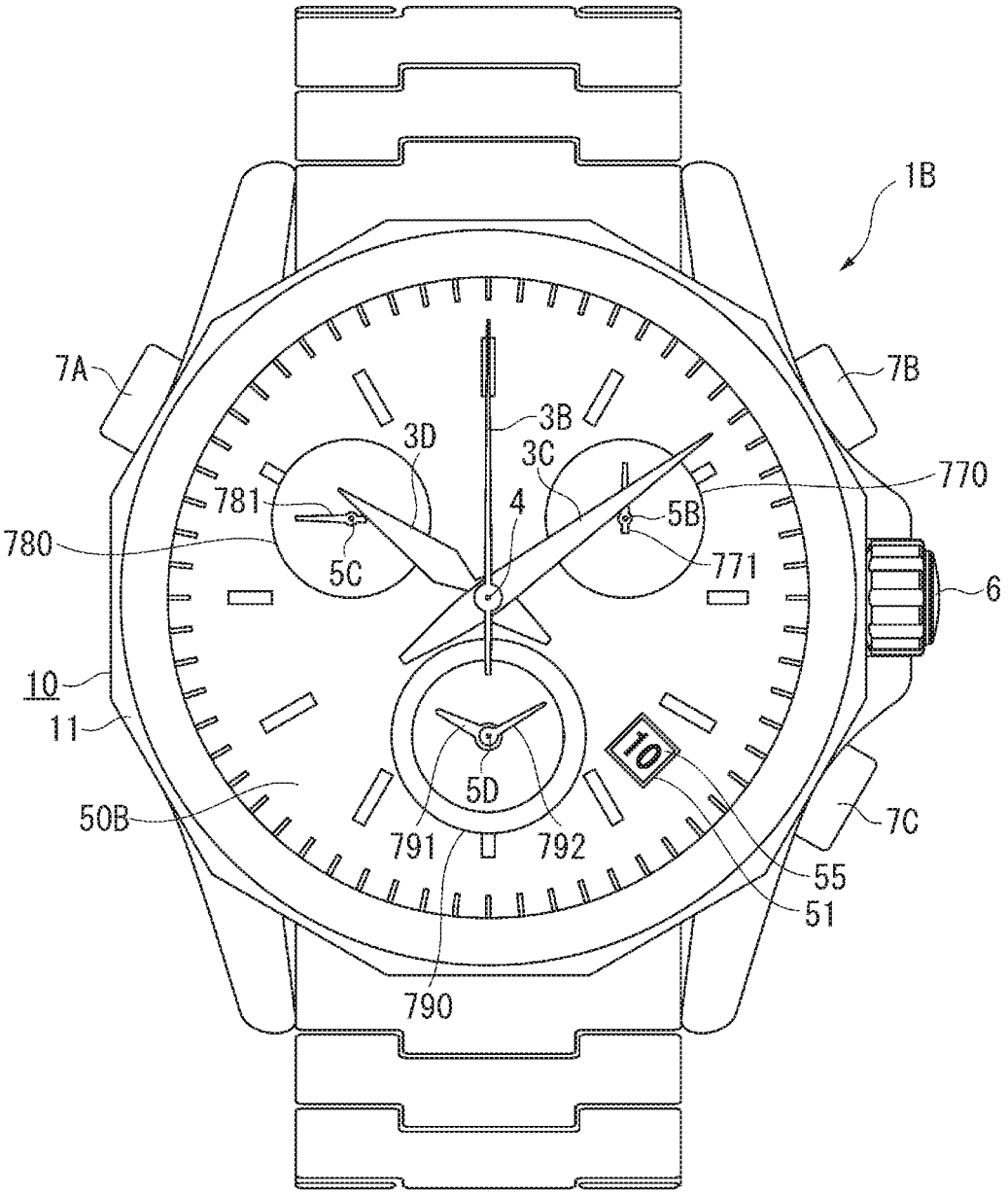
FIG. 8 shows the face of a second electronic timepiece according to a first embodiment of the invention.

As shown in FIG. 8, the electronic timepiece 1B moves the location of the pivot 5B of the small hand 771 of the first subdial 770 to 2:00 from the position in the electronic timepiece 1 described above, and moves the location of the pivot 5C of the small hand 781 of the second subdial 780 to 10:00 from the position in the foregoing electronic timepiece 1.

To position pivot 5B and pivot 5C as described above, the small day first intermediate wheel 151 and small day second intermediate wheel 152 of the fifth wheel train 150B of the fifth motor 105 in the movement 20B of this electronic timepiece 1B are disposed to the same positions as in the electronic timepiece 1 described above. The small day wheel 153, however, is disposed to a position on the 2:00 imaginary line L2 side of the small day second intermediate wheel 152.

In addition, in the sixth wheel train 160B of the sixth motor 106 in this electronic timepiece 1B, the mode indicator first intermediate wheel 161B is configured by the same wheel as the mode indicator first intermediate wheel 161, and is disposed to the same position. The mode indicator second intermediate wheel 162B also functions as the first detection wheel 181.

The mode indicator wheel 163B is the same wheel as the mode indicator wheel 163, and is disposed on the 10:00 imaginary line L10 side of the mode indicator first intermediate wheel 161B. More specifically, in this electronic timepiece 1B, the sixth wheel train 160B is configured with a mode indicator first intermediate wheel 161B, a mode indicator second intermediate wheel 162B that also functions as the first detection wheel 181, and a mode indicator wheel 163B.

As a result, the main plate 21 and wheel train bridge supporting the fifth wheel trains 150, 150B and sixth wheel trains 160, 160B are configured so that the small day wheel 153, mode indicator second intermediate wheel 162, and mode indicator wheel 163 and 163B can be selectively disposed to positions appropriate to the configurations of two different electronic timepieces 1 and 1B. More specifically, holes for supporting the pivots of the wheels in the fifth wheel trains 150, 150B and sixth wheel trains 160, 160B are formed in the main plate 21.

Figure 9:
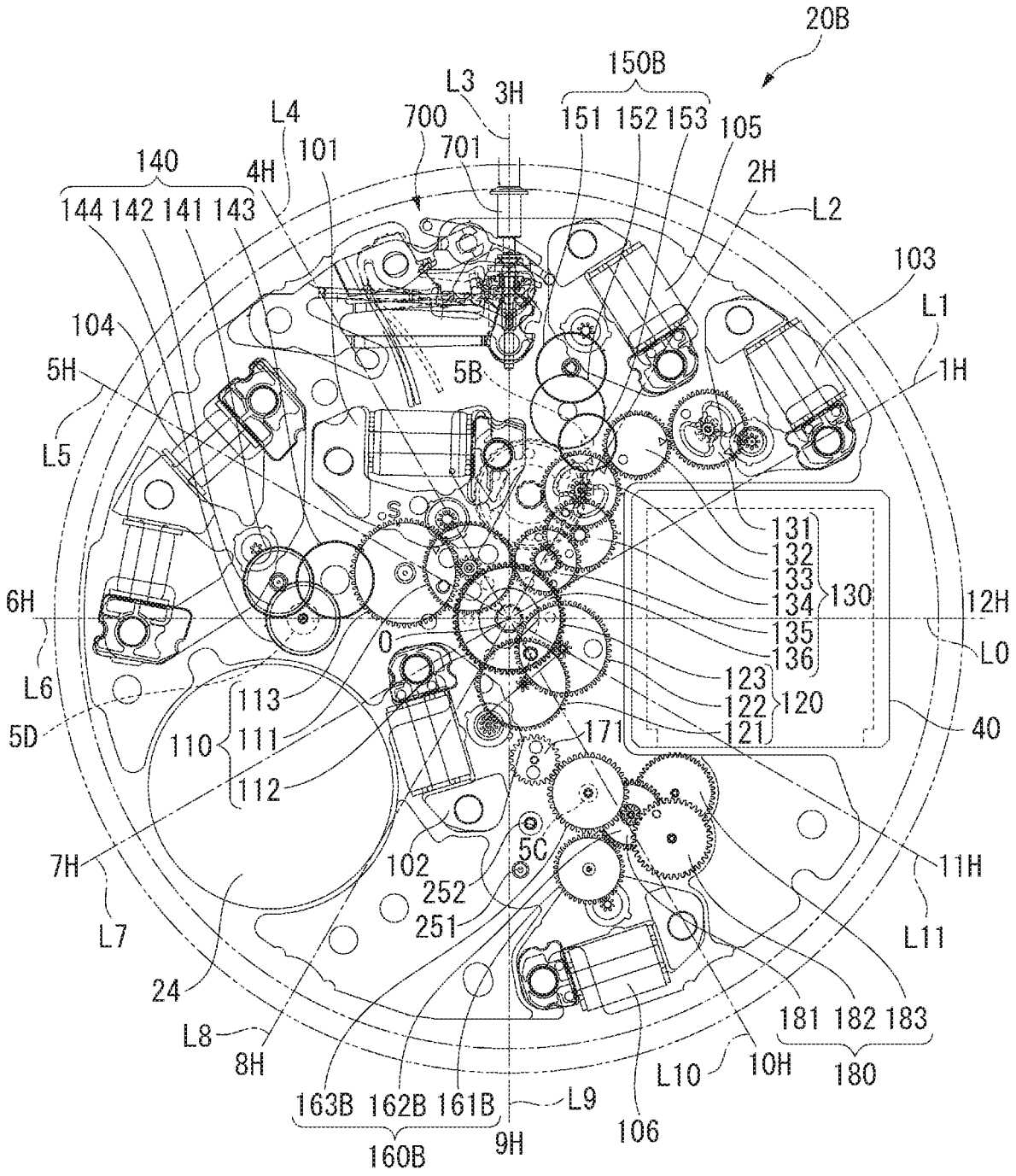
FIG. 9 is a plan view of the face side of the movement of the second electronic timepiece.
Figure 10:
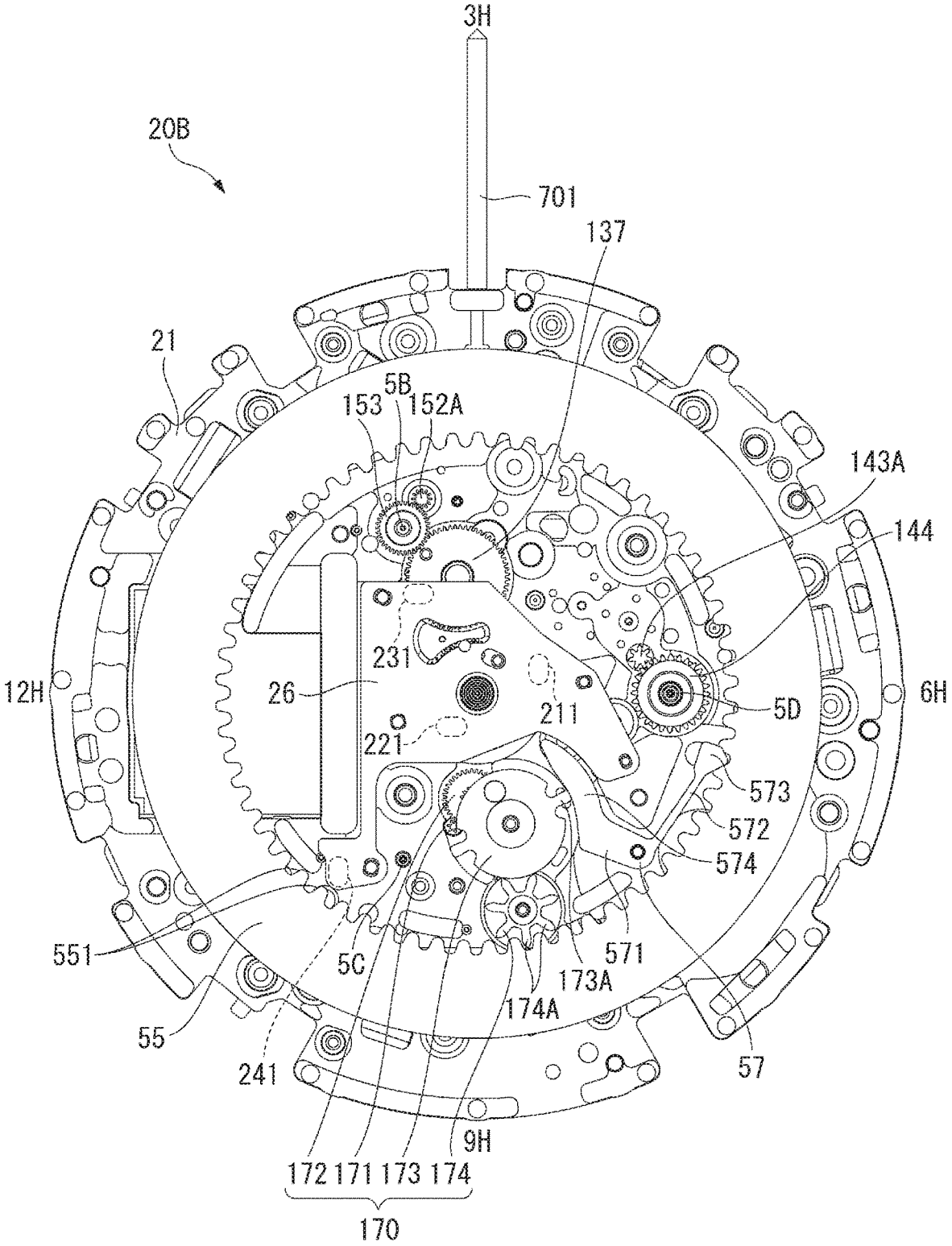
FIG. 10 is a plan view of the back side of the movement of the second electronic timepiece.

As shown in FIG. 3, FIG. 6, and FIG. 9, the mode indicator second intermediate wheel 162 and mode indicator wheel 163 of the sixth wheel train 160, and the mode indicator wheel 163B of the sixth wheel train 160, are selectively disposed. As a result, holes 251 and 252 that support the mode indicator second intermediate wheel 162 and mode indicator wheel 163, and hole 253 that supports the mode indicator wheel 163B, are formed in the main plate 21. Therefore, hole 253 is a hole that supports the pivot of the mode indicator wheel 163B, which is the indicator wheel of the sixth wheel train 160B, and hole 252 is a hole that supports the pivot of the mode indicator wheel 163, which is the indicator wheel of the sixth wheel train 160.

As shown in FIG. 6, recesses 255 and 256 are formed with sufficient tolerance in the main plate 21 so that the wheels do not touch the main plate 21. Protrusions not shown are also formed on the main plate 21 to prevent the wheels from tilting.

The dial 50B of the electronic timepiece 1B is also formed with the first subdial 770 and second subdial 780 at different positions than in the dial 50 of the first electronic timepiece 1 described above. On the back cover side of the main plate 21, the parts through which pivot 5B and pivot 5C pass (such as the date indicator holder and solar panel) also have through-holes through which pivot 5B and pivot 5C can be inserted.

Other aspects of the configuration of the electronic timepiece 1B are the same as in the foregoing electronic timepiece 1, and further description thereof is omitted.

If the approximate 9:00 position where the mode indicator wheel 163 of electronic timepiece 1 is disposed is a first position, and the 10:00 position where the mode indicator wheel 163B of electronic timepiece 1B is disposed is a second position, the sixth wheel train 160 configured by the mode indicator first intermediate wheel 161, mode indicator second intermediate wheel 162, and mode indicator wheel 163 in the first electronic timepiece 1 is the first drive wheel train of the invention. In addition, the sixth wheel train 160B configured by the mode indicator first intermediate wheel 161B the mode indicator second intermediate wheel 162B that also serves as the first detection wheel 181, and the mode indicator wheel 163B is an example of a second drive wheel train of the invention.

In this second electronic timepiece 1B, the indicator position detection wheel train 180 for detecting the position of the small hand 781 is the same as the indicator position detection wheel train 180 in the first electronic timepiece 1. More specifically, the indicator position detection wheel train 180 of the second electronic timepiece 1B also includes the first detection wheel 181, second detection wheel 182 and third detection wheel 183, and these detection wheels 181 to 183 are disposed to the same locations as in the first electronic timepiece 1. The indicator position detector 240 associated with the indicator position detection wheel train 180 is therefore the same as in the first electronic timepiece 1 described above.

Effect of Embodiment 1

Because the location of the indicator position detection wheel train 180 for detecting the position of the small hand 781 is the same in the first electronic timepiece 1 having the mode indicator wheel 163 to which the small hand 781 is attached disposed to approximately 9:00, and the second electronic timepiece 1B having the mode indicator wheel 163B to which the small hand 781 is attached disposed to approximately 10:00, the light-emitting device 241 and photodetector 242 of the indicator position detector 240 can also be disposed to the same locations.

As a result, the same light sensor circuit board 26 to which the light-emitting device 241 is disposed, and the same circuit board 23 to which the photodetector 242 is disposed, can be used in both electronic timepieces 1 and 1B, the number of different parts required to manufacture electronic timepieces 1 and 1B with the mode indicator wheel 163 and mode indicator wheel 163B at different locations can be reduced, and the production cost can be reduced.

Furthermore, because the first detection wheel 181 of the indicator position detection wheel train 180 in the second electronic timepiece 1B also functions as the mode indicator second intermediate wheel 162B, the number of wheels in the sixth wheel train 160 and indicator position detection wheel train 180 is reduced. As a result, the mode indicator wheel 163B can be located near the indicator position detection wheel train 180, and greater freedom of design is achieved in the layout.

Because the small hand 781 and date indicator 55 can be driven by the sixth motor 106 in the electronic timepiece 1, space is conserved and a small, multifunction timepiece can be provided.

The position of the small hand 781 can also be detected by the indicator position detector 240 even when the position of the small hand 781 shifts due to an external disturbance. The small hand 781 can therefore be returned to the reference position based on the detected indicator position, and correct information can be indicated by the small hand 781. In addition, because the relative positions of the small hand 781 and date indicator 55 can be correctly determined, the controller 60 can correctly move the date indicator 55.

Because the position of the small hand 781 is detected when changing the date by the sixth motor 106 moving the date indicator 55, a drop in user convenience can be prevented, and power consumption per day can be reduced. More specifically, when detecting the position of the small hand 781, the small hand 781 turns a maximum six revolutions, and if the position of the small hand 781 is detected during the day when the user is most likely using the electronic timepiece 1, the user may be unable to get desired information from the small hand 781, and user convenience decreases. However, if the small hand 781 position is detected when the date changes, a drop in user convenience can be prevented because the likelihood that the user is not using the electronic timepiece 1 is high.

Furthermore, because the small hand 781 also turns six revolutions when the date is driven, if the position of the indicator is detected when the date changes, the operation of driving the small hand 781 six revolutions can be limited to once a day, and power consumption per day can be reduced.

Furthermore, because the controller 60 executes the indicator position detection process on a regular schedule, the position of the small hand 781 can be automatically corrected. As a result, the small hand 781 can always be moved to the normal position and held in the correct relationship with the date indicator 55 even when the user is not aware that the position of the small hand 781 has shifted. The small hand 781 can therefore always indicate the correct information.

When the sixth wheel train 160 that drives the small hand 781 as an example of a mode indicator, and the indicator position detection wheel train 180 that detects the position of the small hand 781, are disposed independently of each other as shown in FIG. 6, the first detection wheel 181 of the indicator position detection wheel train 180 meshes with the mode indicator first intermediate wheel 161 and not the rotor pinion 106A. As a result, compared with a configuration in which the mode indicator first intermediate wheel 161 and the first detection wheel 181 both mesh with the rotor pinion 106A, the inertial moment on the rotor can be reduced, and the power consumption of the sixth motor 106 required to drive the rotor can be reduced.

Because a dedicated indicator position detection wheel train 180 that moves in conjunction with the sixth wheel train 160 is provided to detect the indicator position by means of the indicator position detector 240, the location of the indicator position detector 240 can be determined more freely, and the layout of the parts in the movement 20 can be designed more freely. In addition, the number and the speed reduction ratio of detection wheels 181 to 183 in the indicator position detection wheel train 180 can also set as desired. As a result, the maximum number of revolutions of the small hand 781 required to detect the indicator position is not limited to six as in this embodiment, and may be five or less or seven or more, enabling easily adapting to the configuration of the indicator position detection wheel train 180.

Embodiment 2

Electronic timepieces 1C and 1D according to the second embodiment of the invention are described next with reference to FIG. 11 and FIG. 12. Note that a feature of the electronic timepieces 1C and 1D according to the second embodiment of the invention is that the indicator wheel to which the second hand is attached can be disposed to a first position or a second position. As a result, only the second motor 301, seconds drive wheel trains 310 and 310B, and the seconds indicator position detection wheel train 320 are shown in FIG. 11 and FIG. 12.

In the first embodiment described above, the mode indicator wheel 163, which is the indicator wheel to which the small hand 781 that also functions as a mode indicator is attached, is configured selectively disposable to a 9:00 position as a first position, and a 10:00 position as a second position.

Figure 11:
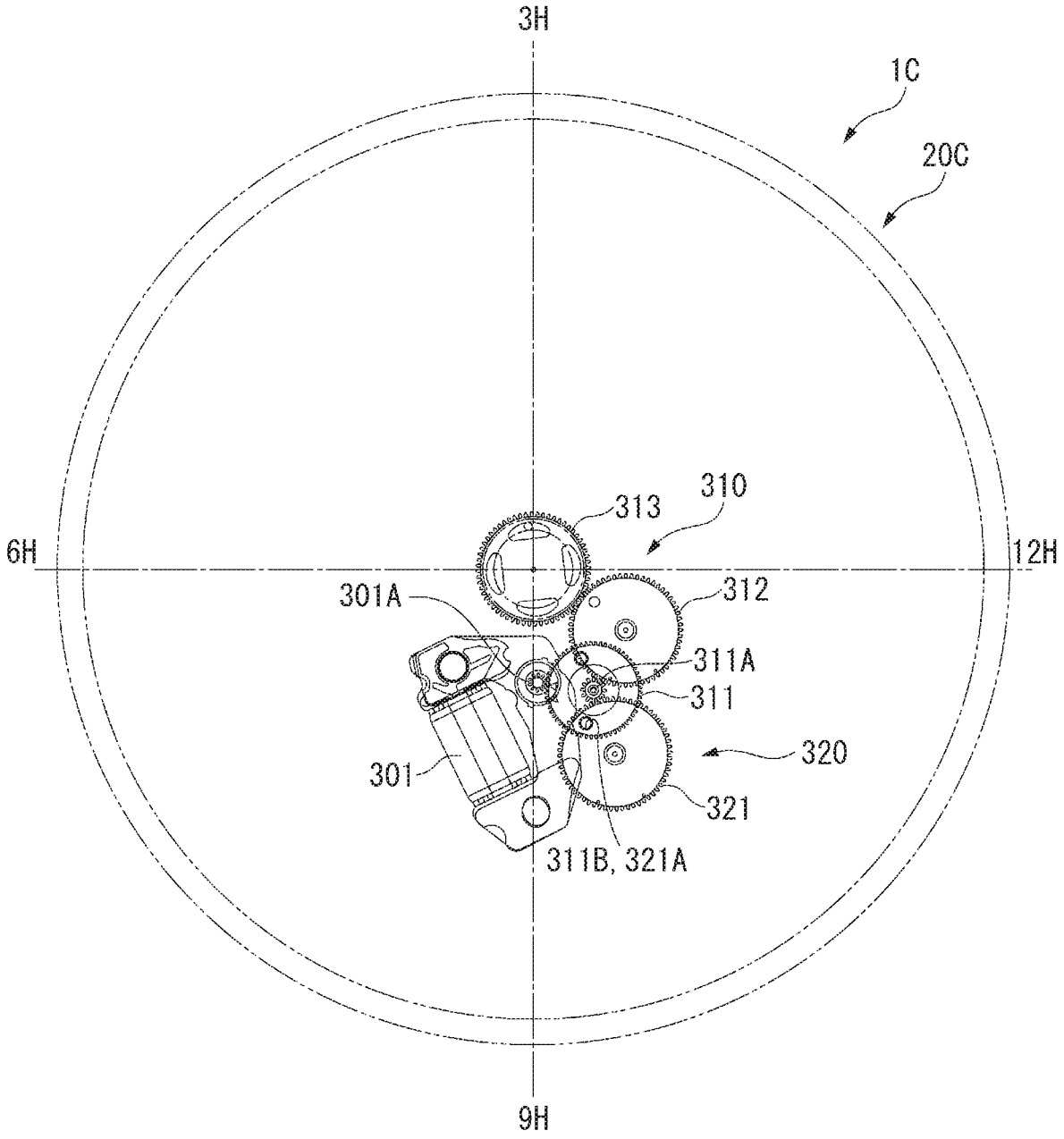
FIG. 11 illustrates the arrangement of main parts of the first movement according to the second embodiment of the invention.
Figure 12:
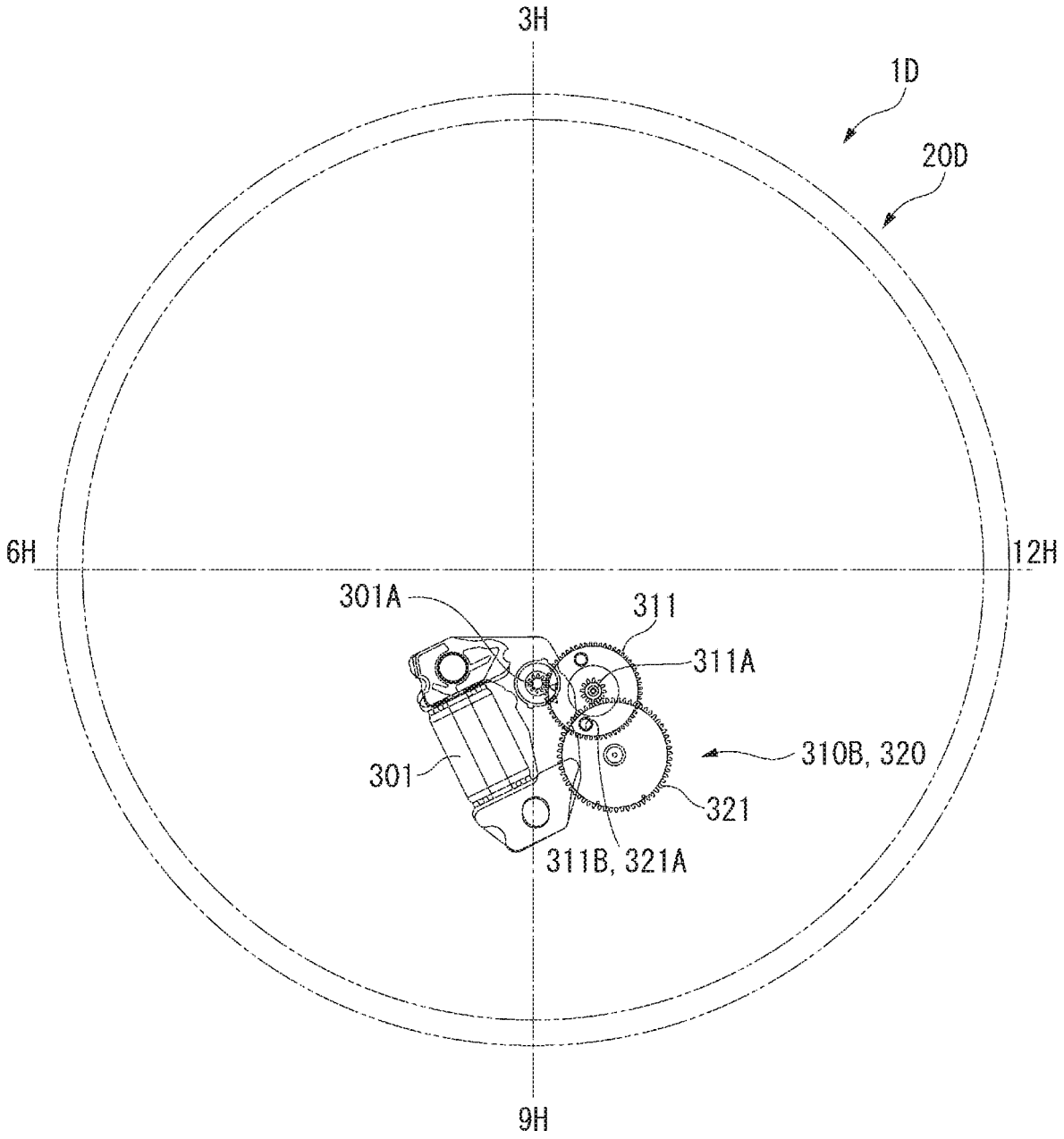
FIG. 12 illustrates the arrangement of main parts of the second movement according to the second embodiment of the invention.

This second embodiment enables selecting whether to dispose the indicator wheel to which the second hand is attached at a first position at the plane center of the dial, that is, disposing the second hand is a center seconds hand as shown in FIG. 11; or to dispose the indicator wheel to which the secondhand is attached to a second position that is different from the plane center of the dial that is the first position, that is, disposing the indicator wheel to a position offset from the plane center near 10:00 as shown in FIG. 12 as a small seconds hand.

As shown in FIG. 11, the movement 20C of a first electronic timepiece 1C according to the second embodiment of the invention includes a seconds first intermediate wheel 311 that meshes with the rotor pinion 301A of the second motor 301, a seconds second intermediate wheel 312 that meshes with the pinion 311A of the seconds first intermediate wheel 311, a seconds wheel 313 that meshes with the seconds second intermediate wheel 312, and a seconds detection wheel 321 that meshes with the pinion 311A of the seconds first intermediate wheel 311. A center seconds hand is attached to the pivot of the seconds wheel 313. As a result, the seconds indicator drive wheel train 310, which is an example of a first drive wheel train, is configured by a seconds first intermediate wheel 311, seconds second intermediate wheel 312, and seconds wheel 313.

The seconds indicator position detection wheel train 320 is configured by the seconds first intermediate wheel 311 and seconds detection wheel 321.

Through-holes 311B and 321A are formed respectively in the seconds first intermediate wheel 311 and seconds detection wheel 321, and the through-holes 311B and 321A are superimposed with each other in plan view at one location during one revolution of the seconds detection wheel 321.

While not shown in the figures, a light-emitting element and a photo detection element are disposed to positions corresponding to the positions of the through-holes 311B and 321A when overlapping in plan view, and by the photo detection element detecting the light from the light-emitting element passing through the through-holes 311B and 321A, the position of the seconds indicator position detection wheel train 320, that is, the position of the center seconds hand that is driven by the seconds indicator drive wheel train 310, can be detected.

As shown in FIG. 12, the movement 20D of a second electronic timepiece 1D according to the second embodiment of the invention includes a seconds first intermediate wheel 311 that meshes with the rotor pinion 301A of the second motor 301, and a seconds detection wheel 321 that meshes with the pinion 311A of the seconds first intermediate wheel 311. A small seconds hand is attached to the pivot of the seconds detection wheel 321. As a result, the seconds indicator drive wheel train 310B, which is an example of a second drive wheel train, and the seconds indicator position detection wheel train 320, are configured by a seconds first intermediate wheel 311 and seconds detection wheel 321.

As in the movement 20C described above, through-holes 311B and 321A are formed in the seconds first intermediate wheel 311 and seconds detection wheel 321 of this movement 20D, and the through-holes 311B and 321A are disposed to be superimposed with each other in plan view at one location during one revolution of the seconds detection wheel 321.

While not shown in the figures, a light-emitting element and a photo detection element are disposed to positions corresponding to the positions of the through-holes 311B and 321A when overlapping in plan view, and by the photo detection element detecting the light from the light-emitting element passing through the through-holes 311B and 321A, the position of the seconds indicator position detection wheel train 320, that is, the position of the small seconds hand that is driven by the seconds indicator drive wheel train 310B, can be detected. As a result, in this second electronic timepiece 1D, the second drive wheel train is the same wheel train as the detection wheel train.

The second embodiment of the invention thus described has the same effect as the foregoing first embodiment. More specifically, the seconds indicator position detection wheel train 320 can be disposed to the same position in the first electronic timepiece 1C having a center seconds hand, and the second electronic timepiece 1D having a small seconds hand. As a result, the photosensor circuit board to which the same light-emitting element is disposed, and the same circuit board to which the photo detection element is disposed, can be used in both electronic timepieces 1C and 1D, the number of different parts required to manufacture electronic timepieces 1C and 1D with the seconds hand at different locations can be reduced, and the production cost can be reduced.

Furthermore, because the seconds first intermediate wheel 311 is used in both the seconds indicator drive wheel train 310 and the seconds indicator position detection wheel train 320 in the first electronic timepiece 1C, and the seconds first intermediate wheel 311 and seconds detection wheel 321 are used in the seconds indicator drive wheel train 310B and the seconds indicator position detection wheel train 320 in the second electronic timepiece 1D, the number of wheels is reduced.

OTHER EMBODIMENTS

The invention is not limited to the embodiments described above, and can be modified and improved in many ways without departing from the scope of the accompanying claims.

For example, the first embodiment does not have an indicator position detector for the small hand 771 that can be attached to the pivot 5B at 3:00 and 2:00, but if an indicator position detector for the small hand 771 is provided, the indicator position detection wheel train may be disposed, like the indicator position detection wheel train 180, to the same position or a different position than the pivot 5B. More specifically, the layout of the subdial locations can be varied by simply changing the location of the small day wheel 153, and the small day first intermediate wheel 151 and small day second intermediate wheel 152 can be disposed to the same positions, in the electronic timepieces 1 and 1B according to the first embodiment of the invention. As a result, different layouts can be easily achieved by forming through-holes for detecting the indicator positions in wheels 151 and 152, and the detection wheel train can be configured using the portion of the wheel train that is common to the first drive wheel train and second drive wheel train.

Likewise, a common indicator position detection wheel train can be provided even when the pivot 5D can be disposed to different positions.

An indicator position detection wheel train can also be disposed to the same position when the minute hand 3C and hour hand 3D can be selectively disposed as center hands or in subdials.

The scheduled indicator position detection process of the small hand 781 is executed in the foregoing embodiments when the date advances, but may be executed at times other than when driving the date indicator, such as at 7:00 a.m. or 12:00 a.m.

In addition, the indicator position detection process of the small hand 781 may execute when the user operates a button 7A to 7C or the crown 6 to change the date, or when the date indicator 55 is adjusted by receiving time information. In this case, considering the effects of backlash, the indicator position detection process does not execute when the date indicator 55 turns in reverse, and the indicator position detection process executes only when the date indicator 55 is turning forward.

The display member driven by the same sixth motor 106 that drives the small hand 781 is the date indicator 55 in the embodiments described above, but the display member may be any member for displaying time-based information. Examples of such display members including a subdial for displaying home time (local time), a 24-hour hand that displays time with one revolution per 24 hours, or a calendar wheel displaying information other than the date.

Calendar wheels displaying information other than the date include a day wheel displaying the weekday, a month wheel displaying the month, or a moon phase wheel. In other words, the display member may be any member for displaying information based on time, and is normally driven at a regular interval.

The sixth motor 106 is provided as a drive motor for driving the small hand 781 and date indicator 55, but may be used only for driving the small hand 781. In this configuration, the position of the small hand 781 may be detected at most once per revolution, and the number of wheels in the indicator position detection wheel train 180 can be reduced.

The second drive wheel train in the foregoing embodiments may be configured using some of the wheels in the detection wheel train, or using all of the wheels in the detection wheel train, but the second drive wheel train may be configured independently of the detection wheel train. For example, the detection wheel train may be disposed to a position that can mesh with the mode indicator wheel 163 at a first position and the mode indicator wheel 163 at a second position as in the first intermediate date wheel 171 in the first embodiment. However, using one or more wheels of the detection wheel train in the second drive wheel train as described in the foregoing embodiments is preferable to reduce the number of wheels and simplify the layout.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A movement comprising:

an indicator wheel to which an indicator is attached;

a detection wheel train used to detect a position of the indicator;

a motor configured to drive the indicator wheel and the detection wheel train; and a main plate to which the indicator wheel, the motor, and the detection wheel train are disposed, configured to enable selectively disposing the indicator wheel to a first position or a second position different from the first position with the detection wheel train disposed to the same position whether the indicator wheel is disposed to the first position or the second position.

2. The movement described in claim 1, wherein:

the main plate has a hole formed at the first position and the second position to support a pivot of the indicator wheel.

3. The movement described in claim 1, wherein:

the main plate is configured to enable selectively disposing a first drive wheel train that drives the indicator wheel disposed to the first position, and a second drive wheel train that drives the indicator wheel disposed to the second position; and the detection wheel train is driven linked to the first drive wheel train or the second drive wheel train.

4. The movement described in claim 3, wherein:

the detection wheel train has a wheel; and the second drive wheel train is configured by multiple wheels including the wheel of the detection wheel train.

5. The movement described in claim 1, wherein:

the motor has a rotor pinion;

the main plate is configured to enable disposing a drive wheel train including a first intermediate wheel that meshes with the rotor pinion, and a second intermediate wheel that meshes with the first intermediate wheel, and drives the indicator wheel; and the detection wheel train is configured to include a first detection wheel that meshes with the first intermediate wheel and is different from the second intermediate wheel.

6. An electronic timepiece comprising:

an indicator;

an indicator wheel to which the indicator is attached;

a detection wheel train used to detect a position of the indicator;

a motor configured to drive the indicator wheel and the detection wheel train; and a main plate to which the indicator wheel, the motor, and the detection wheel train are disposed, enabling selectively disposing the indicator wheel to a first position or a second position different from the first position with the detection wheel train disposed to the same position whether the indicator wheel is disposed to the first position or the second position.

* * * * *